US007766197B2

(12) United States Patent
Getsy

(10) Patent No.: US 7,766,197 B2
(45) Date of Patent: Aug. 3, 2010

(54) CLOSURE WITH SELECTABLE DISPENSING ORIFICES

(75) Inventor: Stephen B. Getsy, Pittsburgh, PA (US)

(73) Assignee: Silgan Plastics Corporation, Chesterfield, MO (US)

( * ) Notice: Subject to any disclaimer, the term of this patent is extended or adjusted under 35 U.S.C. 154(b) by 687 days.

(21) Appl. No.: 11/363,631

(22) Filed: Feb. 28, 2006

(65) Prior Publication Data

US 2007/0199959 A1 Aug. 30, 2007

(51) Int. Cl.
*B67D 3/00* (2006.01)

(52) U.S. Cl. ..... 222/480; 222/142.7; 220/253

(58) Field of Classification Search ..... 222/480, 222/556, 498, 253, 318, 525, 575, 211, 478, 222/481, 482, 486, 489, 142.6–142.9, 457.5; 220/525, 253–255, 256.1
See application file for complete search history.

(56) References Cited

U.S. PATENT DOCUMENTS 1,386,043 A * 8/1921 Wilson ..... 222/498
1,769,815 A * 7/1930 Wilson ..... 222/555
2,697,485 A 12/1954 McNally
2,817,451 A * 12/1957 Giles et al. ..... 215/230
2,961,133 A * 11/1960 Ankney ..... 222/548
3,058,630 A * 10/1962 Abt ..... 222/484
3,094,283 A 6/1963 Balister
3,100,589 A * 8/1963 Love, Jr. ..... 222/480
3,891,128 A 6/1975 Smrt
4,346,823 A 8/1982 Eppenbach
4,487,324 A * 12/1984 Ostrowsky ..... 215/253
4,489,864 A 12/1984 Davis
4,598,837 A * 7/1986 Kreiseder et al. ..... 220/253
4,611,725 A 9/1986 Kacalieff
4,625,898 A * 12/1986 Hazard ..... 222/517
4,699,299 A * 10/1987 Gach ..... 222/480

(Continued)

OTHER PUBLICATIONS

Cheetos Squeeze Tube product images, available to Assignee at least by Jun. 22, 2005, 1 page.

(Continued)

*Primary Examiner*—Lien T Ngo
(74) *Attorney, Agent, or Firm*—Reinhart Boerner Van Deuren s.c.

(57) ABSTRACT

A dispenser for dispensing a viscous material in a selected one of a multiplicity of configurations comprises a container for a volume of a viscous material and having a squeezable body and a neck with a discharge opening at its upper end. Engaged on the container is a closure body of generally circular cross section having a top wall and a skirt, and the top wall has a discharge passage therethrough aligned with the discharge opening of the neck. The body top wall has a generally circular recess therein extending from the periphery thereof and beyond the discharge passage of the closure. Disposed in the circular recess is a generally circular rotating disc which has a multiplicity of discharge openings spaced about the disc in a circular array, and the discharge openings have a multiplicity of configurations. The disc is rotatable to align a selected discharge opening with the discharge passage in the top wall to permit viscous material to flow through the neck and the top wall of the closure body into and through a selected disc discharge opening.

26 Claims, 4 Drawing Sheets

U.S. PATENT DOCUMENTS

| | | | | |
|---|---|---|---|---|
| 4,832,219 | A | 5/1989 | Nycz | |
| 5,123,574 | A | 6/1992 | Poulos | |
| 5,195,645 | A | 3/1993 | Schuermann | |
| 5,269,432 | A | 12/1993 | Beckertgis | |
| 5,383,582 | A | 1/1995 | Baxter et al. | |
| 5,421,472 | A | 6/1995 | Beckertgis | |
| 5,730,322 | A * | 3/1998 | Iba et al. | 222/42 |
| 5,738,236 | A | 4/1998 | Brun, Jr. | |
| 5,954,241 | A * | 9/1999 | Huang | 222/548 |
| 6,003,711 | A * | 12/1999 | Bilewitz | 220/253 |
| 6,286,767 | B1 | 9/2001 | Hui-Chen | |
| 6,446,842 | B2 | 9/2002 | Stern et al. | |
| 6,488,187 | B2 | 12/2002 | Sheffler et al. | |
| 6,766,922 | B2 * | 7/2004 | da Silva | 222/211 |
| 6,766,926 | B1 * | 7/2004 | Elchert | 222/498 |
| 7,201,288 | B2 * | 4/2007 | von Ronn et al. | 220/253 |
| 2003/0042331 | A1 | 3/2003 | Lu | |
| 2003/0116879 | A1 * | 6/2003 | Mueller et al. | 264/142 |
| 2005/0061765 | A1 * | 3/2005 | Skillin et al. | 215/235 |
| 2006/0191932 | A1 * | 8/2006 | Bocola | 220/254.3 |
| 2006/0237560 | A1 | 10/2006 | Chih | |
| 2006/0243759 | A1 * | 11/2006 | King et al. | 222/548 |
| 2007/0144996 | A1 * | 6/2007 | Sawyer | 215/235 |
| 2007/0199962 | A1 | 8/2007 | Mengeu | |

OTHER PUBLICATIONS

Notice of Allowance for U.S. Appl. No. 11/363,632, mailing date Dec. 11, 2008, 8 pages.

* cited by examiner

CLOSURE WITH SELECTABLE DISPENSING ORIFICES

BACKGROUND OF THE INVENTION

The present invention relates to containers and, more particularly, to containers for dispensing viscous materials such as foodstuffs and decorative materials.

Dispensers for various types of viscous materials include tubes of frosting, sealant cartridges, toothpaste tubes and the like. In some instances, the dispensers have a fitment which provides both a large aperture and a small aperture for dispensing, either of which may be selected depending upon the volume to be dispensed.

Some food products employ packaging which allows children to dispense a food product by squeezing a compressible container containing a viscous comestible such as cheese, peanut butter, jelly and the like. The child is able to make patterns of the food product on a cracker or bread slice, thus providing some play action.

It is an object of the present invention to provide a novel squeezable container for a viscous product which can be discharged through a dispensing closure which provides a multiplicity of discharge openings of different cross section.

It is also an object to provide such a container which permits facile switching among the several discharge openings.

Another object is to provide such a squeezable container which may be readily assembled from easily fabricated components.

SUMMARY OF THE INVENTION

It has now been found that the foregoing and related objects can be readily attained in a dispenser for dispensing a viscous material in a selected one of a multiplicity of configurations comprising a container for a volume of a viscous material and having a squeezable body and a neck with a discharge opening at its upper end. A closure body of generally circular cross section having a top wall and a skirt is engaged on the container, and the top wall has a discharge passage therethrough aligned with the discharge opening of the neck. The top wall has a generally circular recess therein extending from the periphery thereof and beyond the discharge passage of the closure body. Disposed in the circular recess is a generally circular rotatable disc having a multiplicity of flow openings spaced thereabout in a circular array. The flow openings provide a multiplicity of configurations and the disc is rotatable to align a selected flow opening with the discharge passage in the top wall. This permits viscous material to flow through the neck and top wall of the closure into and through a selected disc flow opening. The container neck is externally threaded and in the bottom surface of the closure body top wall has a depending threaded barrel portion which is threadably engaged with the neck.

Generally the container is a flexible tubular member sealed at the end opposite the neck. The closure also desirably, includes an overcap having a top wall and a peripheral skirt, and the lower surface of the top wall of the overcap includes a circular boss concentric therewith and bearing on the disc. The means for rotatably mounting the disc preferably comprises an aperture in the closure top wall and a mounting post on the disc which snaps into the aperture.

DETAILED DESCRIPTION OF THE PREFERRED EMBODIMENTS

Figure 1:
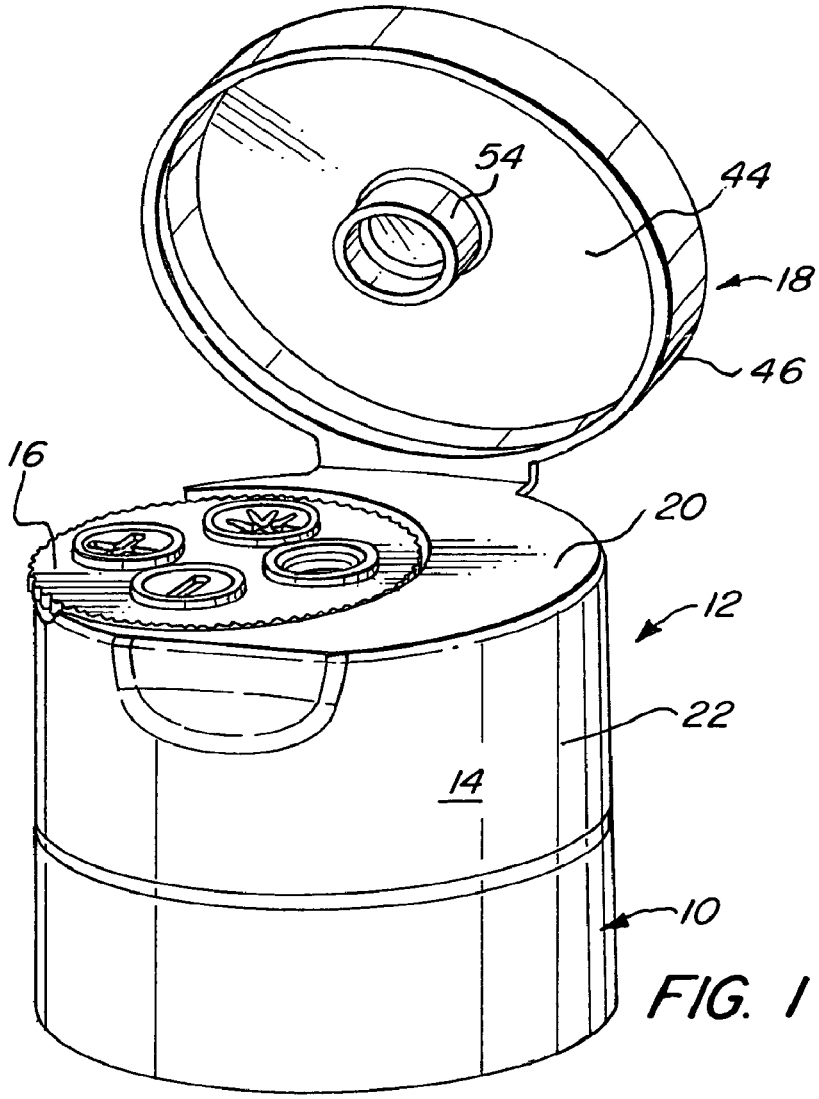
FIG. 1 is a perspective view of a container embodying the present invention with the overcap in an open position and with the tubular container fragmentarily illustrated.

Turning first to FIG. 1 of the attached drawings, therein illustrated is a dispenser embodying the present invention comprising a tubular container generally designated by the numeral 10 and a dispensing closure generally designated by the numeral 12. The closure 12 has a body generally designated by the numeral 14, a dispenser disc generally designated by the numeral 16, and an overcap generally designated by the numeral 18.

As seen in FIGS. 2-6, the closure body 14 has a top wall 20 and a peripheral depending skirt 22. A threaded barrel 24 depends from the lower surface of the top wall 20 and is threadably engaged with the neck 26 of the container 10, and the lip 28 of the container neck 26 bears against the annular ring 30 on the lower surface of the top wall 20.

Figure 2:
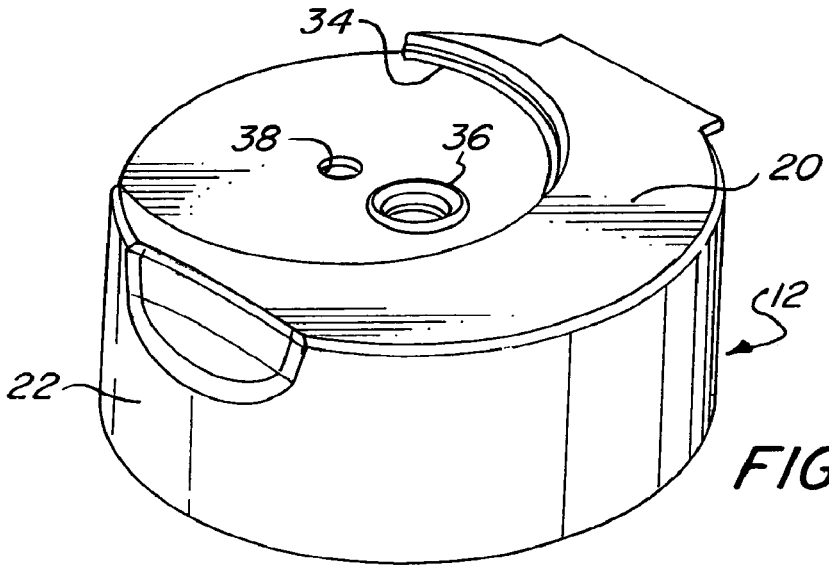
FIG. 2 is a perspective view of the closure body with the disc and overcap removed.
Figure 3:
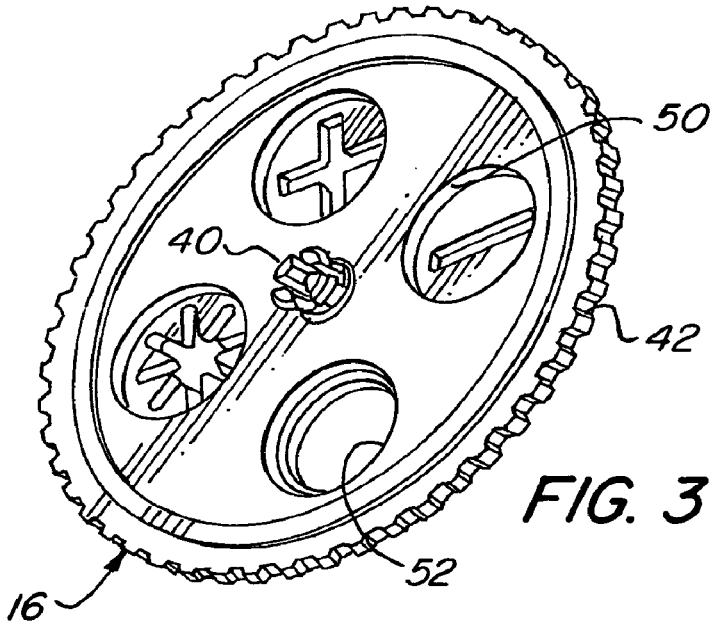
FIG. 3 is a perspective view of the disc.
Figure 4:
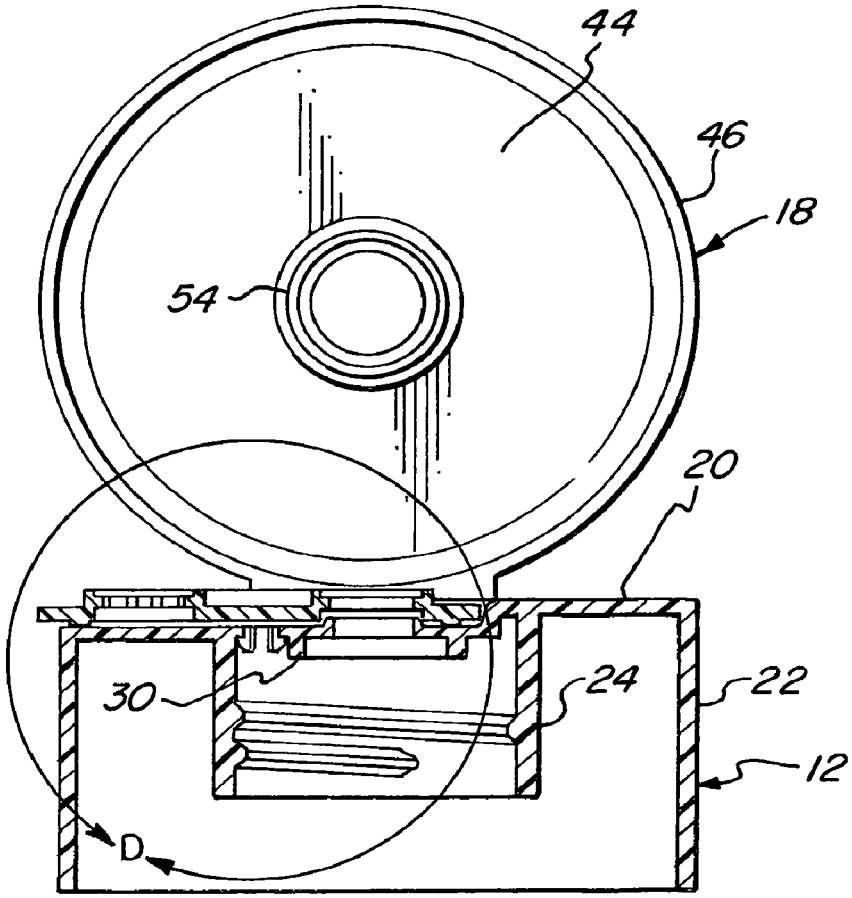
FIG. 4 is an elevational view of the closure in partial section with the overcap open.
Figure 5:
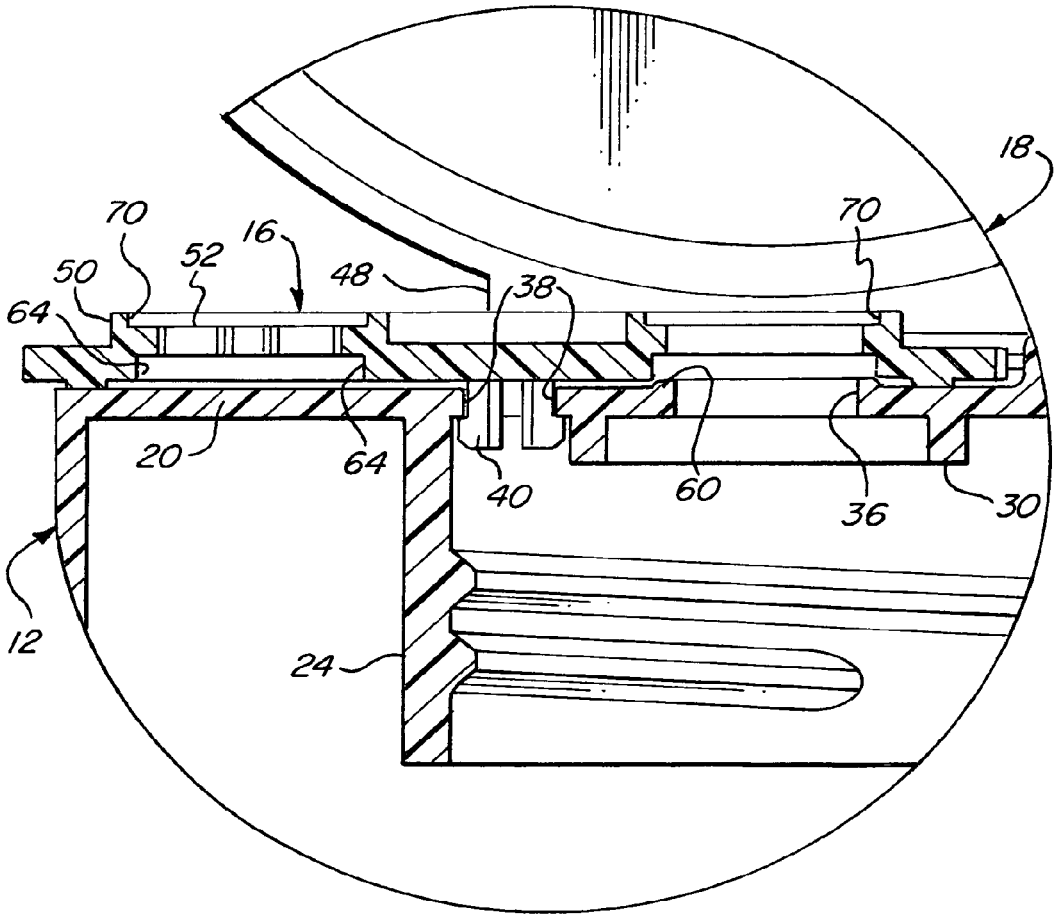
FIG. 5 is an enlarged view in partial section of the portion of the closure bounded by the circle D in FIG. 4.
Figure 6:
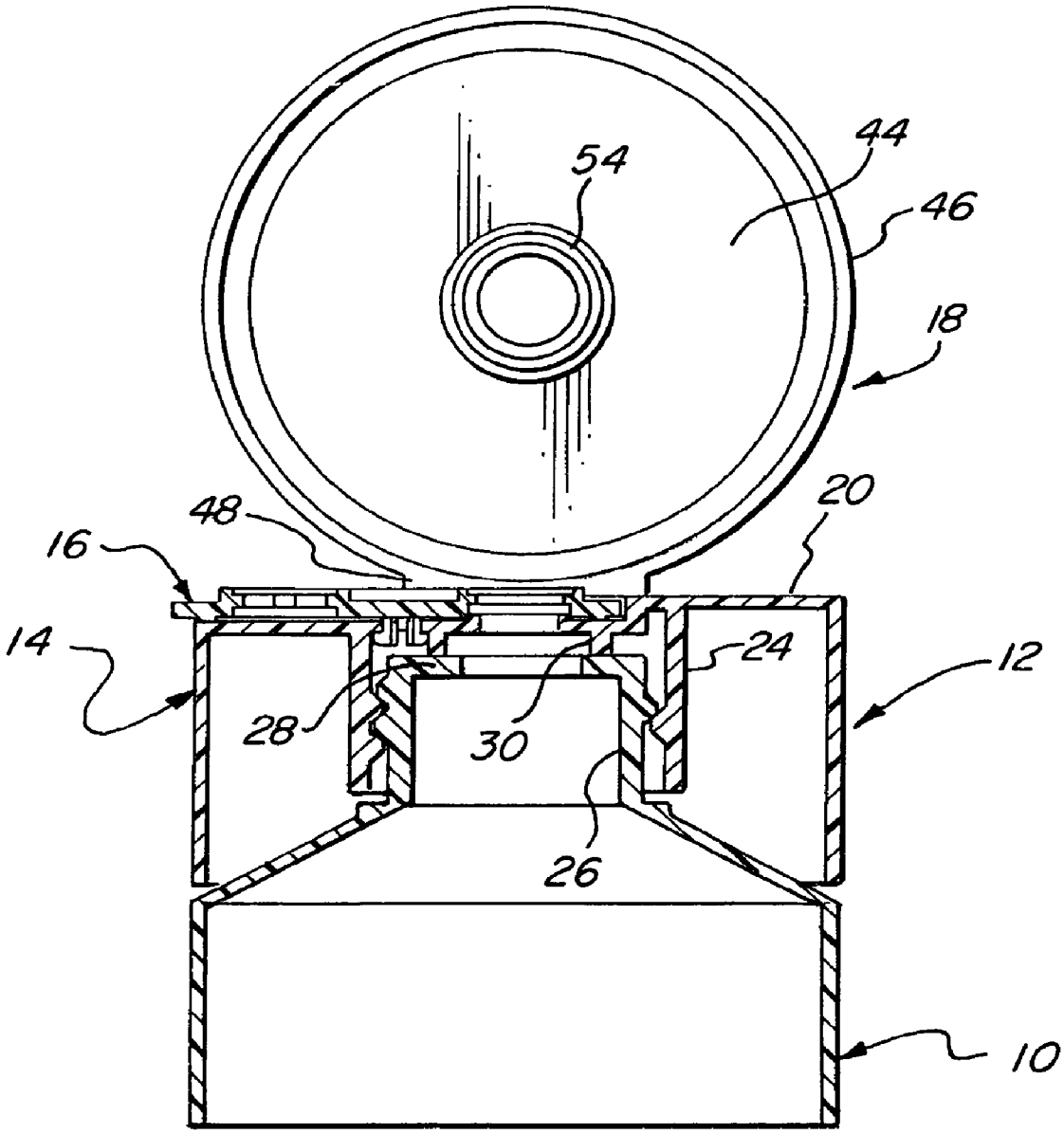
FIG. 6 is a sectional view with the closure on the container.

As seen in FIG. 2, the top wall 20 has a circular recess 34 which extends from the periphery thereof to beyond a central aperture 36 about which is a small ring 60 on the upper surface. As seen in FIG. 5, the top wall 20 has an aperture 38 offset from the barrel 24.

Turning now in detail to the disc 16, it is of circular configuration dimensioned to rotatably seat in the recess 34. At its center is a depending snap fastener 40 which is snap fit into the aperture 38 to provide rotatable engagement. The periphery of the disc 16 is provided with teeth 42 to facilitate its rotation. Spaced about the snap fastener 40 are four bosses 50 with discharge openings 52 of different configurations.

As best seen in FIG. 5, the top surface of the top wall 20 has an annular ring 60 around the central aperture 36 and the lower surface of the disc 16 has a recess 64 around each of the discharge openings 52 in which the annular ring 60 seats to provide a positive stop in the rotation of the disc.

The overcap 18 has a top wall 44 and a peripheral skirt 46. The closure is integrally molded with a living hinge 48, and a ring boss 54 bears upon the disc 16 in the closed position. The bosses 50 have a recess 70 about the upper end of the discharge openings 52 in which the ring boss 54 on the overcap 18 seats to reduce drying out of the product.

It will be readily appreciated that the squeezable container can take the form of a tube or a bottle, and it can be easily fabricated by extrusion and molding of tubular shapes, and injection and blow molding of synthetic resin to form bottles in accordance with general technology. The resin employed should allow facile squeezing to compress the container and force material to flow outwardly of the container. Polyolefins have proven highly acceptable for such applications.

The closure and disc do not require a flexible construction and are also conveniently molded from polyolefins although other more rigid resins may also be employed.

The three components are easily fabricated and assembled. Preferably, the disc and closure may be assembled and then threaded onto the container. The container can be filled through the neck, or, in the instance of tubes, they can be filled and then the opposite end is closed and sealed.

In use, the child (or adult) can rotate the disc to align the discharge opening of the desired configuration in the operational position. Squeezing the container will then force material to flow from the interior of the container through the neck into the aperture and then outwardly through a discharge opening. The discharging material has the shape or configuration of the discharge opening selected and continuous beads or small deposits can be generated. When the squeezing pressure on the container is released, flow from the container ends. The material in the closure passages can be "sealed" by rotating the disc to a position in which the discharge apertures are not aligned with the discharge passage in the top wall.

Thus, it can be seen from the foregoing detailed description and the attached drawings that the present invention provides a novel squeezable container for a viscous product which can be discharged through a dispensing closure which provides a multiplicity of discharge openings of different cross sections. The container permits facile switching among the several discharge openings and it may be readily assembled from easily fabricated components.

Having thus described the invention, what is claimed is:

1. A dispenser comprising:

(a) a container for a volume of a material and having a squeezable body and a neck, the neck of the container having an opening at its upper end;

(b) a closure body of generally circular cross section having a top wall and a skirt extending from the periphery of the top wall, the skirt defining an outer surface of the closure body, the top wall having a discharge passage therethrough aligned with the opening of the neck, the closure body having means thereon engaging the container, the top wall having a generally circular recess; and (c) a generally circular disc disposed in the circular recess, the disc having a peripheral edge and having a multiplicity of discharge openings spaced thereabout in a circular array, the discharge openings having a multiplicity of configurations, the disc being rotatable in the recess to align a selected discharge opening with the discharge passage in the closure top wall to permit material to flow through the neck and top wall of the closure into and through the selected disc discharge opening;

(d) wherein at least a portion of the peripheral edge of the disc extends beyond the outer surface of the closure body such that the disc may be rotated by the application of force to the portion of the peripheral edge of the disc;

(e) wherein the discharge passage is located within the circular recess and is positioned generally in the center of the top wall, and further wherein an axis of rotation of the disc is located between the outer surface of the closure body and the discharge passage.

2. The dispenser of claim 1 wherein the container neck is externally threaded and wherein the bottom surface of the closure body top wall has a depending threaded barrel threadably engaged on the neck.

3. The dispenser of claim 1 wherein the container is a flexible tubular member sealed at the end opposite the neck.

4. The dispenser of claim 1 wherein the closure includes an overcap having a top wall and a peripheral skirt.

5. The dispenser of claim 4 wherein the lower surface of the top wall of the overcap includes a circular boss concentric therewith and bearing on the disc.

6. The dispenser of claim 1 further comprising an aperture in the closure body top wall and a mounting post on the disc which snaps into the aperture.

7. A closure configured to be coupled to a container, the closure comprising:

(a) a top wall, the top wall having a recess, a peripheral edge and a discharge passageway; and (b) a disc including a peripheral edge and a plurality of discharge openings, the disc positioned in the recess and attached for movement to the top wall, the disc sized such that at least a portion of the peripheral edge of the disc extends beyond the peripheral edge of the top wall, the peripheral edge of the disc engageable for movement from beyond the peripheral edge of the top wall to allow a user to move the disc to selectably align one of the plurality of discharge openings with the discharge passageway;

wherein a radius of the disc at the portion of the peripheral edge of the disc that extends beyond the peripheral edge of the top wall is less than the radius of the top wall.

8. The closure of claim 7 further comprising a skirt extending from the peripheral edge of the top wall and a barrel extending from a bottom surface of the top wall, the barrel configured to be coupled to a neck of the container.

9. The closure of claim 8 wherein the barrel is threaded to engage threading located on the neck of the container.

10. The closure of claim 7 wherein a first discharge opening of the plurality of discharge openings has a first configuration and a second discharge opening of the plurality of discharge openings has a second configuration, the second configuration being different from the first configuration.

11. The closure of claim 7 wherein the recess of the top wall is a generally circular recess, and further wherein the disc is generally circular and is rotatably attached to the top wall within the recess.

12. The closure of claim 11 wherein the recess includes an aperture and the disc includes a mounting post which snaps into the aperture of the recess, the disc being rotatable about the axis of the mounting post.

13. The closure of claim 7 wherein the closure is coupled to a container.

14. The closure of claim 13 wherein the container is squeezable to force contents of the container through the plurality of discharge openings.

15. The closure of claim 7 further comprising an overcap, the overcap having a ring boss extending from a bottom surface of the overcap, wherein the disc includes a recess around the upper end of a first discharge opening of the plurality of discharge openings, wherein the overcap is movable from an open position to a closed position, and further wherein the ring boss of the overcap is configured to seat within the recess around the upper end of the first discharge opening when the overcap is moved to the closed position.

16. The closure of claim 15 further comprising a living hinge coupling the overcap to the top wall.

17. The closure of claim 7 further comprising an annular ring extending from a top surface of the top wall around the discharge passageway.

18. The closure of claim 17 further comprising a recess positioned on a lower surface of the disc around a first discharge opening of the plurality of discharge openings, wherein, when the disc is moved to align the first discharge opening with the discharge passageway of the top wall, the annular ring seats within the recess positioned on a lower surface of the disc around the first discharge opening.

19. The closure of claim 7 wherein the discharge passageway is positioned in the center of the top wall.

20. The closure of claim 7 wherein the peripheral edge of the disc includes a plurality of teeth.

21. The closure of claim 7 wherein the recess extends from the peripheral edge of the top wall beyond the discharge passageway of the top wall.

22. The closure of claim 7 wherein a second portion of the peripheral edge of the disc is positioned within an area defined by the peripheral edge of the top wall.

23. The dispenser of claim 1 wherein a radius of the disc is less than the radius of the top wall of the closure body.

24. The dispenser of claim 23 wherein the disc is permitted to rotate at least 360 degrees within the recess.

25. The closure of claim 7 wherein the disc is rotatable within the recess and is permitted to rotate at least 360 degrees within the recess.

26. The closure of claim 7 wherein the discharge passageway is located within the recess and is positioned generally in the center of the top wall, wherein the disc is rotatable within the recess, and further wherein an axis of rotation of the disc is located between the peripheral edge of the top wall and the discharge passageway.

* * * * *